US010689791B2

(12) United States Patent
Bing et al.

(10) Patent No.: US 10,689,791 B2
(45) Date of Patent: Jun. 23, 2020

(54) HIGH EFFICIENCY VENTED DRYER HAVING A HEAT PUMP SYSTEM

(71) Applicant: QINGDAO HAIER WASHING MACHINE CO., LTD., Shandong (CN)

(72) Inventors: Jindong Bing, Shandong (CN); Sanwei Lu, Shandong (CN)

(73) Assignee: QINGDAO HAIER WASHING MACHINE CO., LTD., Shandong (CN)

( * ) Notice: Subject to any disclaimer, the term of this patent is extended or adjusted under 35 U.S.C. 154(b) by 137 days.

(21) Appl. No.: 15/754,115

(22) PCT Filed: Aug. 9, 2016

(86) PCT No.: PCT/CN2016/094141

§ 371 (c)(1),
(2) Date: Feb. 21, 2018

(87) PCT Pub. No.: WO2017/036281

PCT Pub. Date: Mar. 9, 2017

(65) Prior Publication Data

US 2018/0245269 A1 Aug. 30, 2018

(30) Foreign Application Priority Data

Aug. 31, 2015 (CN) ..... 2015 1 0549166

(51) Int. Cl.
*F26B 3/00* (2006.01)
*D06F 58/10* (2006.01)
(Continued)

(52) U.S. Cl.
CPC ..... *D06F 58/10* (2013.01); *D06F 58/206* (2013.01); *D06F 2103/50* (2020.02); *D06F 2105/26* (2020.02)

(58) Field of Classification Search
CPC ..... D06F 58/10; D06F 58/206; D06F 58/24; D06F 2058/287
(Continued)

(56) References Cited

U.S. PATENT DOCUMENTS

2010/0154248 A1* 6/2010 Stolze ..... D06F 58/206 34/493
2010/0263225 A1* 10/2010 Balerdi Azpilicueta ..... D06F 58/206 34/134
(Continued)

FOREIGN PATENT DOCUMENTS

CN 101939479 A 1/2011
CN 102002843 A 4/2011
(Continued)

OTHER PUBLICATIONS

Extended European Search Report dated Jul. 30, 2018 in corresponding European Patent Application No. 16840710.4-1018, 7 pages.
(Continued)

*Primary Examiner* — John P McCormack
(74) *Attorney, Agent, or Firm* — Buchanan Ingersoll & Rooney PC

(57) ABSTRACT

A high efficiency vented dryer having a heat pump system comprises an outer drum, an air-intake drying air duct and an air-exhaust drying air duct for allowing the outer drum communicating with outside. The dryer is provided with a heat pump system comprising a first evaporator and a second evaporator arranged in parallel or in series. The first evaporator is arranged in the air-exhaust drying air duct and the second evaporator is arranged in an external atmosphere to absorb heat from the exhaust air and outside, respectively. By arranging the evaporators in the drying air duct and the external atmosphere respectively, the heat pump system can
(Continued)

simultaneously or independently absorb heat from the air exhausted by the dryer and from the ambient air of the dryer to heat the intake air by using heat in the exhaust air and heat in the environment to improve drying rate of the dryer.

14 Claims, 3 Drawing Sheets

(51) Int. Cl.
*D06F 58/20* (2006.01)
*D06F 103/50* (2020.01)
*D06F 105/26* (2020.01)

(58) Field of Classification Search
USPC ..... 34/514, 513, 512, 108
See application file for complete search history.

(56) References Cited

U.S. PATENT DOCUMENTS

| | | | |
|---|---|---|---|
| 2011/0000099 | A1 | 1/2011 | Steffens |
| 2012/0159972 | A1 | 6/2012 | Haryanto et al. |
| 2015/0197882 | A1 | 7/2015 | Ahn et al. |

FOREIGN PATENT DOCUMENTS

| | | | |
|---|---|---|---|
| CN | 102286872 | A | 12/2011 |
| CN | 102510980 | A | 6/2012 |
| CN | 104532522 | A | 4/2015 |
| DE | 102013226398 | A1 | 6/2015 |
| EP | 2385169 | A1 | 11/2011 |
| EP | 2460928 | A1 | 6/2012 |
| EP | 2573252 | A1 | 3/2013 |
| EP | 2599912 | A1 | 6/2013 |
| EP | 2886708 | A1 | 6/2015 |
| JP | H01212599 | A | 8/1989 |
| JP | 2007143631 | A | 6/2007 |
| JP | 2008086424 | A | 4/2008 |
| JP | 2008173330 | A | 7/2008 |
| JP | 2008245927 | A | 10/2008 |
| JP | 2009066398 | A | 4/2009 |
| JP | 2012130473 | A | 7/2012 |
| KR | 20140147026 | A | 12/2014 |

OTHER PUBLICATIONS

Chinese Retrieval Report dated Apr. 8, 2019 in corresponding Chinese Patent Application No. 201510549166.3, 2 pages.
Office Action (Notice of Reasons for Refusal) dated Aug. 27, 2019 in corresponding Japanese Patent Application No. 2018-510953 with English Translation, 8 pages.
Office Action (Notification of Reasons for Refusal) dated Aug. 12, 2019 in corresponding Korean Patent Application No. 2018-7007660 with English Translation, 17 pages.

* cited by examiner

HIGH EFFICIENCY VENTED DRYER HAVING A HEAT PUMP SYSTEM

TECHNICAL FIELD

The present disclosure relates to a clothes drying apparatus in the field of the household appliances, in particular, relates to a high efficiency vented dryer having a heat pump system.

BACKGROUND

The existing dryer mainly comprises two following ways:

The first one is a heat pump dryer, and its working principle is as follows: the outer drum is connected with both end of the drying air duct to form a circulating air pathway. The air stream in the drying air duct is heated by the condenser of the heat pump system and becomes hot dry air, and then is introduced into the outer drum. The hot dry air introduced into the outer drum gasifies the moisture of the clothes therein. The gasified moisture is mixed into the air and the air becomes hot moist air, and then the hot moist air is exhausted from the outer drum and introduced into the drying air duct. The moisture is condensed from the hot moist air introduced into the drying air duct by the evaporator, and then the hot moist air becomes the low-temperature dry air. Then the low-temperature dry air flows through the evaporator again, to complete the circulation of air stream. Through the continuous operation of the dryer to generate the above circulating air flow, the purpose of drying the clothes is eventually achieved.

The second one is an air vented dryer, and its working principles is as follows: the dryer draws air from the surrounding area, heats the air by using the heating wire, then the heated high-temperature dry air is blown into the outer drum, and the moisture of the clothes therein is vaporized. The vaporized moisture is mixed into the air and the air becomes hot moist air. The hot moist air is exhausted from the outer drum eventually to realizing the purposes of drying the clothes. However, since the exhaust air contains a large amount of waste heat in the above manner, it cannot be recycled, resulting in large energy consumption and low efficiency.

In view of this, a vented dryer having a heat pump system is proposed. The vented dryer is provided with a heat pump system, and recycles the heat in the exhaust air using the evaporator of the heat pump system, transfers the collected heat to the condenser of the heat pump system, and heats the intake air of the dryer using the condenser.

However, the vented dryer adopting the above methods consumes a large amount of energy, and the heat absorption of the refrigerant medium in the heat pump system cannot reach the saturation point, resulting in a relatively low drying speed. Therefore, how to provide a vented heat pump dryer with a relatively high drying speed and an energy-saving effect becomes a research and development hotspot of the manufactures.

In view of this, the present disclosure is proposed.

SUMMARY

The first object of the present invention is to provide a high efficiency dryer having a heat pump system to realize the purpose of simultaneously recycling the heat in the exhaust air and the external air by the heat pump system of the dryer. The second object is to provide a dryer to achieves the purpose of dehumidifying the external environment where the dryer is located.

In order to realize the objectives of the invention, technical solutions as follows are adopted.

A high efficiency vented dryer having a heat pump system, comprising: an outer drum, an air-intake drying air duct and an air-exhaust drying air duct for allowing the outer drum communicating with outside respectively, wherein the dryer is further provided with a heat pump system, the heat pump system comprises a first evaporator and a second evaporator arranged in parallel or in series. The first evaporator is arranged in the air-exhaust drying air duct and the second evaporator is arranged in an external atmosphere so as to absorb heat from the exhaust air and the outside respectively.

Further, an air-intake end and an air-out end of the first evaporator and the second evaporator are respectively provided with a control valve for controlling on-off, so that the refrigerant medium in the heat pump system flows through the first evaporator and the second evaporator independently or at the same time.

Further, the air-intake end of the first evaporator and the air-intake end of the second evaporator are respectively communicated with an air-out end of a throttling device of the heat pump system through a first three-way control valve. The air-out end of the first evaporator and an air-out end of the second evaporator are respectively communicated with the air-out end of a compressor of the heat pump system through a second three-way control valve.

Further, the air-out end of the first evaporator is respectively communicated with the air-intake end of the second evaporator and the air-intake end of the compressor of the heat pump system through a third three-way control valve. The air-out end of the second evaporator is communicated with the air-intake end of the compressor of the heat pump system through a one-way valve.

Further, at a later stage of a drying process of the dryer, the heat pump system is in a first state in which the refrigerant medium only flows through the first evaporator without flowing through the second evaporator. At an earlier stage of the drying process of the dryer, the heat pump system is in a second state in which the refrigerant medium simultaneously flows through the first evaporator and the second evaporator.

Further, a condenser of the heat pump system is arranged in the air-intake drying air duct. An air-intake end of the condenser is communicated with the air-out end of the compressor of the heat pump system, and the air-out end of the condenser is communicated with the air-intake end of the throttling device of the heat pump system.

Further, the compressor of the heat pump system is arranged in the air-intake drying air duct located upstream from the condenser to preheat the intake air stream.

Further, the air-intake drying air duct is provided with an auxiliary heating wire, and the auxiliary heating wire is located downstream from the condenser. The air-exhaust drying air duct is provided with a fan controlling the flow direction of the air stream, and the fan is located upstream from the first evaporator.

Further, a second fan is arranged outside the air-exhaust drying air duct and is close to the air inlet of the second evaporator so as to provide an acting force to the air at the second evaporator. It enables that an airflow flows through the second evaporator.

In order to achieve the objectives of the invention, technical solutions as follows are further adopted.

A high efficiency vented dryer having a heat pump system, comprising: an outer drum, an air-intake drying air duct and an air-exhaust drying air duct for communicating the outer drum (1) with outside (3) respectively. The dryer is further provided with a heat pump system. the evaporator of the heat pump system crosses the air-exhaust drying air duct, so that a first portion of the evaporator (5) is located in the air-exhaust drying air duct while a second portion of the evaporator (5) is located in the outside.

By adopting the above technical solutions, the present disclosure has the following advantages compared with the prior art.

By arranging the evaporators in the drying air duct and the external atmosphere, respectively, the heat pump system can simultaneously or independently absorb heat from the air exhausted by the dryer and the ambient air of the dryer to heat the intake air by using heat in the exhaust air and heat in the environment, so as to improve drying rate of the dryer.

Besides, the dryer of the present invention can respectively execute different working states at the earlier stage and later stage of the drying process to improve the heat absorption saturation of the refrigerant medium and improve the working efficiency of the heat pump system.

Moreover, during the process of absorbing heat from the air in the environment, the second evaporator also condenses and collects the water vapor from the air in the environment so as to achieve the purpose of dehumidifying the air in the environment by the dryer.

Meanwhile, the structure of the present disclosure is simple, the method is concise, and the effect is remarkable. It is suitable for promotion.

Description of main components: 1—outer drum, 2—air-intake drying air duct, 3—air-exhaust drying air duct, 4—condenser, 5—evaporator, 6—auxiliary heating wire, 7—filter net 8—fan, 9—compressor, 10—throttling device, 11—first three-way control valve, 12—second three-way control valve, 13—first portion, 14—second portion, 15—first evaporator, 16—second evaporator, 17—third three-way control valve, 18—one-way valve, 19—second fan, 20—air-intake end, 21—air-out end, 22—air inlet, 23—air outlet.

DETAILED DESCRIPTION

The following is further and specific description of the present disclosure with accompanying embodiment.

Figure 1:
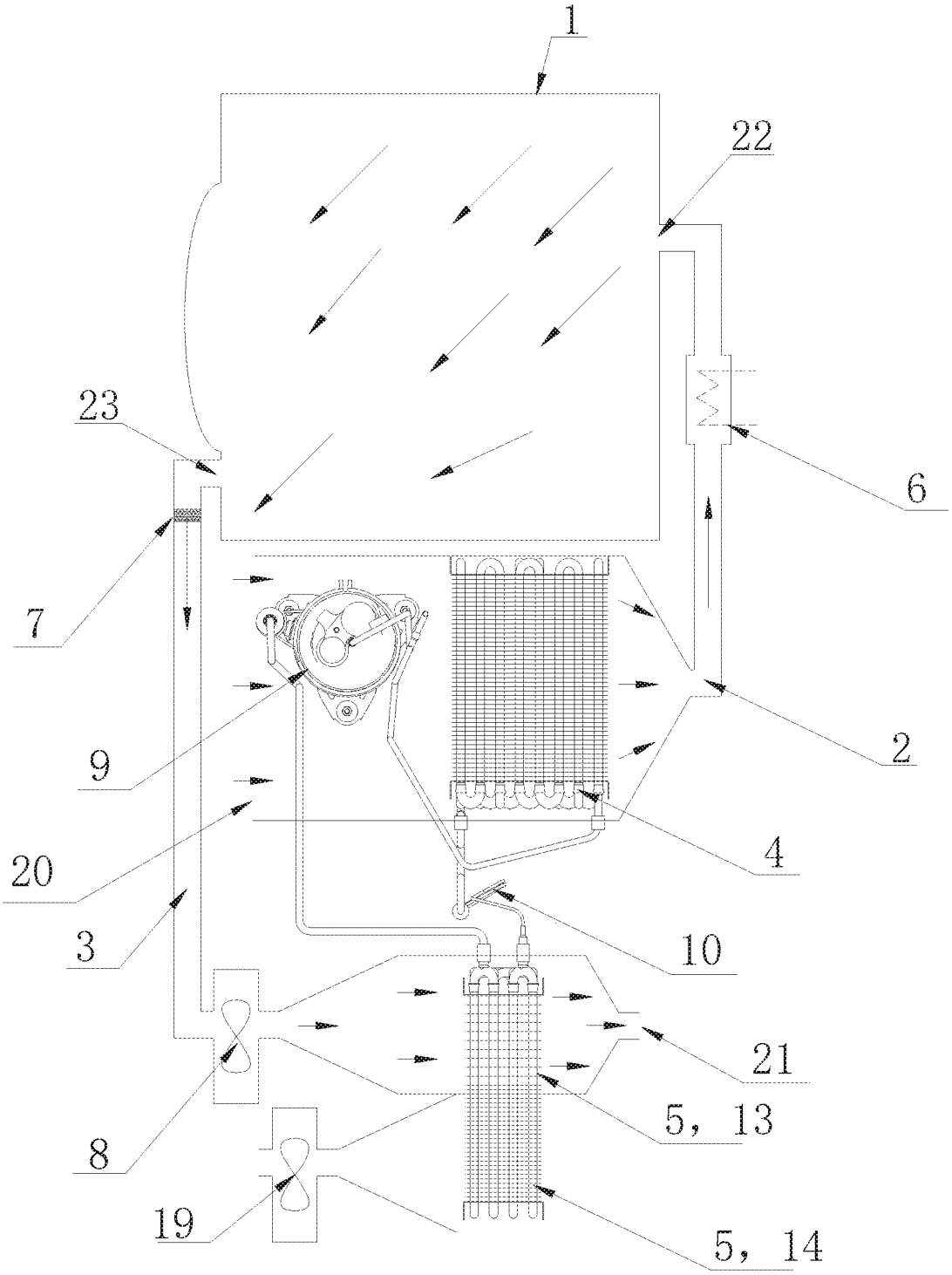
FIG. 1 is a structure schematic diagram of a dryer in an embodiment of the present disclosure.
Figure 2:
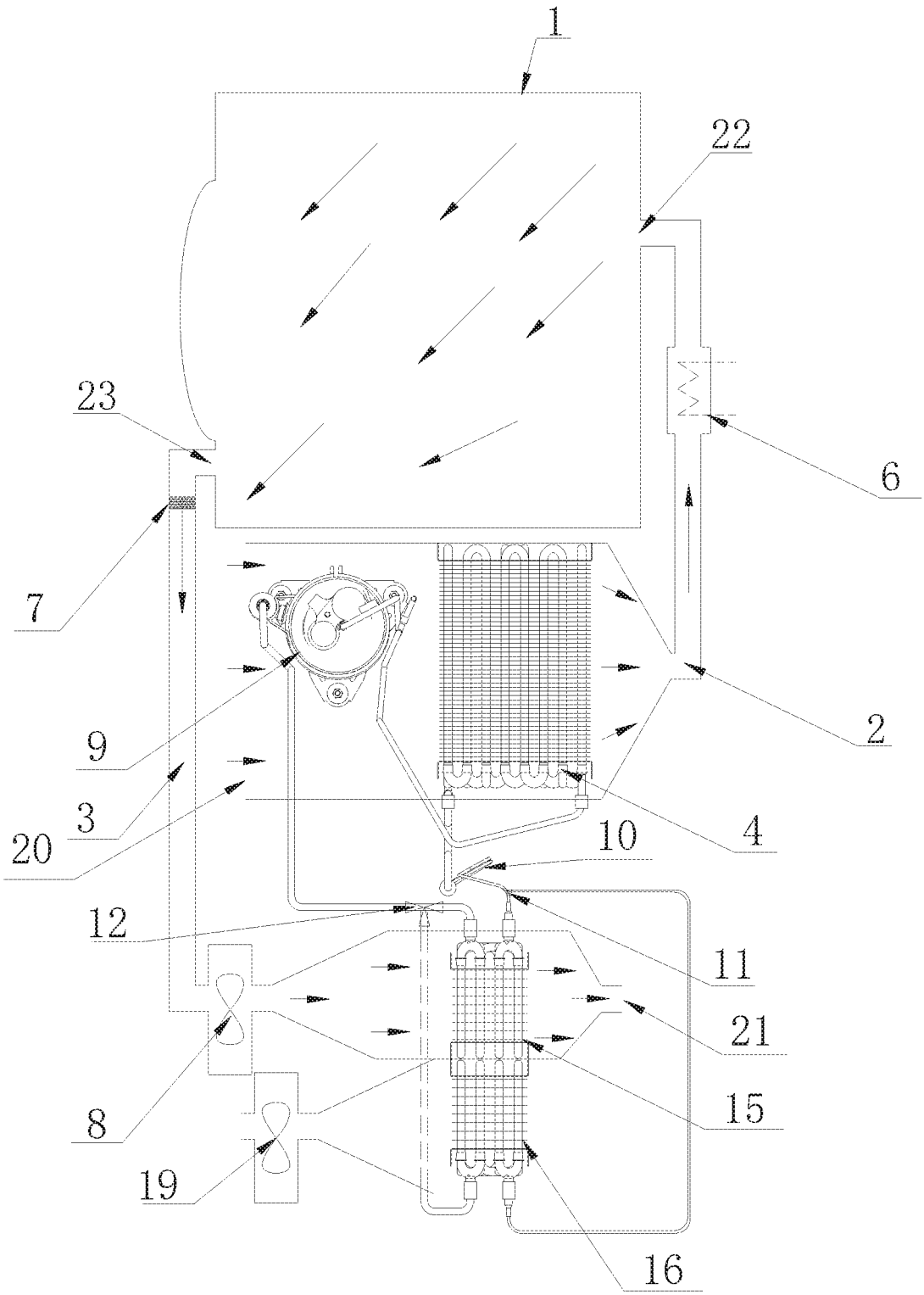
FIG. 2 is a structure schematic diagram of a dryer in another embodiment of the present disclosure.
Figure 3:
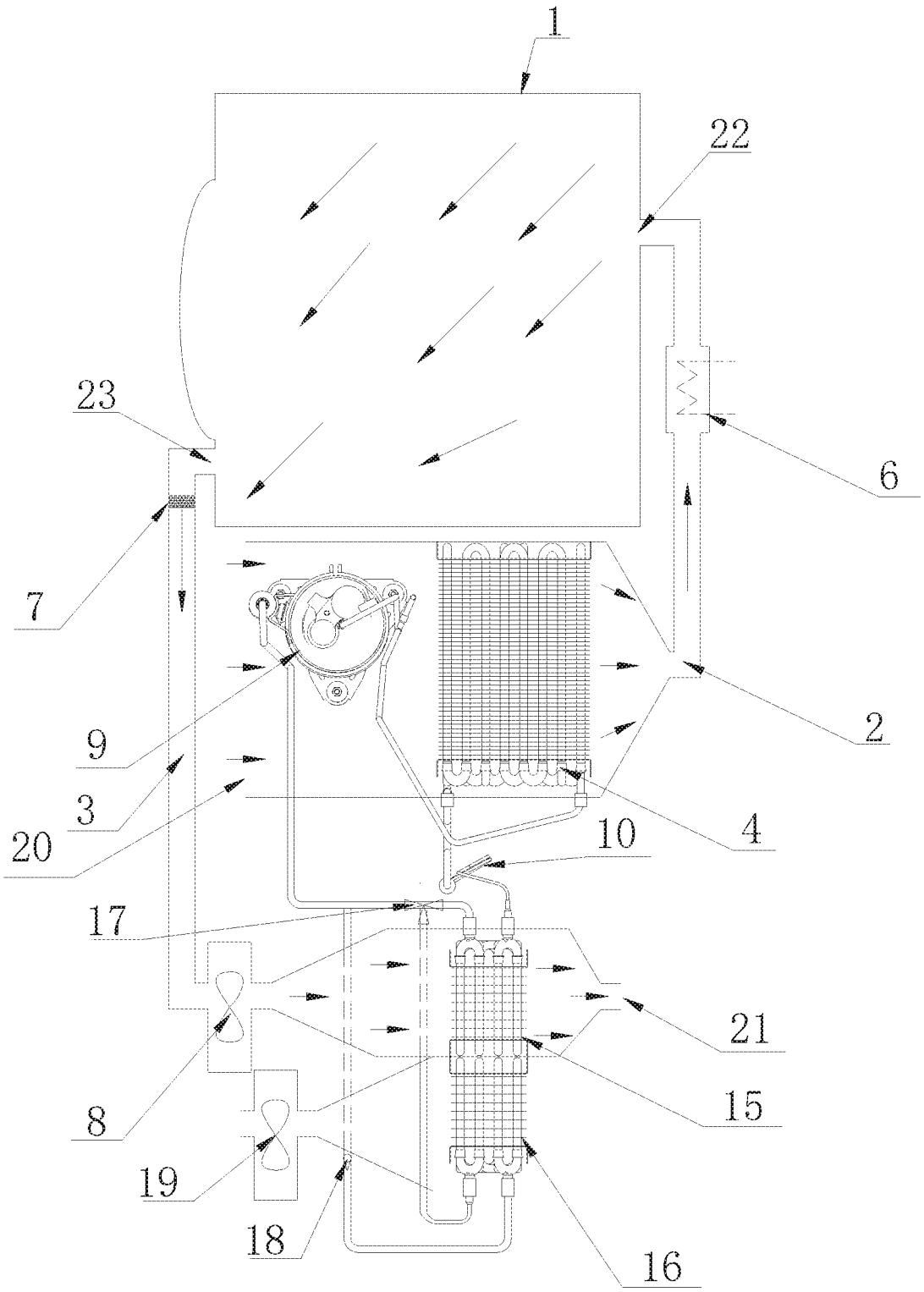
FIG. 3 is a structure schematic diagram of a dryer in a third embodiment of the present disclosure.

As shown in from FIG. 1 to FIG. 3, a vented dryer having a heat pump system provided in the embodiment of the present disclosure comprises an outer drum 1, an air-intake drying air duct 2, and an air-exhaust drying air duct 3. One end of the air-intake drying air duct 2 is communicated with air inlet of the outer drum, and another end is an air-intake end 20 which is communicated with the atmosphere. One end of the air-exhaust drying air duct 3 is communicated with the air outlet 23 of the outer drum, and another end is an air-out end 21 which is communicated with the atmosphere. The dryer is further provided with a heat pump system. The heat pump system at least comprising the condensers 4, a throttling device 10, an evaporator 5 and a compressor 9, which are sequentially connected end to end via a pipeline to from a flow channel for circulating the refrigerant.

In the embodiment of the present disclosure, a condenser is arranged in the air-intake drying air duct 2, and an evaporator 5 is arranged in the air-exhaust drying air duct 3. An outlet end of the compressor 9 is an end for allowing the refrigerant to flow out from the compressor, and this outlet end is connected with the condenser 4 through the pipeline. An inlet end of the compressor 9 is the end for allowing the refrigerant to flow into the compressor, and this inlet end is connected with the evaporator 4 through the pipeline. Therefore, under the action of the compressor, the refrigerant medium in the heat pump system circulates in the direction from the outlet end of the compressor to the condenser, the throttling device, the evaporator, and to the inlet end of the compressor. It achieves the purposes of heating the intake air stream which flows through the condenser, and cooling the exhaust air stream which flows through the evaporator, and then achieves the purpose of drying the clothes inside the outer drum.

In the embodiment of the present disclosure, in order to improve the working efficiency of the heat pump system, the compressor 9 is arranged in the air-intake drying air duct 2 located upstream from the condenser 4 to preheat the intake air stream by using the heat radiation during the operation of the compressor. In order to improve the heating speed of the intake air stream and increasing the temperature of the intake air stream flowing into the outer drum, it is preferable that the air-intake drying air duct 2 is provided with an auxiliary heating wire 6 for electrically heating the air stream passing through. Further and preferably, the auxiliary heating wire 6 is arranged in the air-exhaust drying air duct 2 located downstream from the condenser 4, to improve the electric heating efficiency.

In the embodiment of the present disclosure, the air intake drying air duct and/or the air-exhaust drying air duct is provided with a fan 8 for controlling the air stream direction in the air passage. Preferably, the fan 8 is only arranged in the air-exhaust drying air duct 3 and located upstream from the evaporator 5. So that the air stream in the air-intake drying air duct 2 flows from the air-intake end 20 to the air inlet 22, and the air stream in the outer drum 1 flows from the air inlet 22 to the air outlet 23, and the air stream in the air-exhaust drying air duct 3 flows from the air outlet 23 to the air-out end 21.

In the embodiment of the present disclosure, the air-exhaust drying air duct 3 is provided with a filter net 7 for filtering the threads in the exhaust air stream. The filter net 7 is arranged in the air-exhaust drying air duct 3 and located upstream from the fan 8 and close to the air outlet 23.

As shown in from FIG. 4 to FIG. 5, a high efficiency vented dryer having a heat pump system is provided in the embodiment of the present disclosure. The heat pump system of the dryer is provided with a first evaporator 15 and a second evaporator 16 arranged in parallel or in series. The first evaporator 15 is arranged in the air-exhaust drying air duct 3 and the second evaporator 16 is arranged in an external atmosphere.

By arranging the evaporators in the drying air duct and the external atmosphere, respectively, the heat pump system can simultaneously or independently absorb heat from the air exhausted by the dryer and the ambient air of the dryer to heat the intake air by using heat in the exhaust air and heat in the environment, so as to improve drying rate of the dryer. Meanwhile, during the process of absorbing heat from the air in the environment, the second evaporator also condenses and collects the water vapor from the air in the environment so as to achieve the purpose of dehumidifying the air in the environment by the dryer.

Preferably, a second fan 19 is arranged outside the air-exhaust drying air duct 3 and is close to the air inlet of the second evaporator 16, so as to provide an acting force to the air at the second evaporator. It enables that an airflow flows through the second evaporator.

Embodiment 1

As shown in FIG. 2, in the present embodiment, the air-intake end of the first evaporator 15 and the air-intake end of the second evaporator 16 are respectively communicated with the throttling device 10 of the heat pump system through a first three-way control valve 11. The air-out end of the first evaporator 15 and the air-out end of the second evaporator 16 are respectively communicated with the air-intake end of the compressor 9 of the heat pump system through a second three-way control valve 12. So that the first evaporator 15 and the second evaporator 16 are arranged in parallel and then are connected to the heat pump system.

The three-way control valves are respectively arranged at the air-intake end and the air-out end of the first evaporator 15 and the second evaporator 16 arranged in parallel so as to control the flow direction of the refrigerant medium. So that realizes the purpose that the first evaporator 15 and the second evaporator 16 can simultaneously or separately absorb heat by using the refrigerant medium flowing through them.

Preferably, in this embodiment, when the dryer is at different working stages, the heat pump is correspondingly in different states to improve the heat absorption saturation of the refrigerant medium and improve the working efficiency of the heat pump system. Specific implementations are as follows:

At the later stage of the drying process of the dryer, the heat pump system is in the first state. The first three-way control valve 11 is only communicated with the air-intake end of the first evaporator 15 and the air-out end of the throttling device, and the second three-way control valve 12 is only communicated with the air-out end of the first evaporator 15 and the air-intake end of the compressor. It allows the refrigerant medium to only flow through the first evaporator 15, without flowing through the second evaporator 16. So that the heat pump system only uses the first evaporator 15 to absorb heat from the exhaust air.

At the earlier stage of the drying process of the dryer, the heat pump system is in the second state. The first three-way control valve 11 simultaneously communicates the air-intake end of the evaporator 15 and the air-intake end of the second evaporator 16 to the air-out end of the throttling device 10. The second three-way control valve 12 simultaneously communicates the air-out end of the first evaporator 15 and the air-out end of the second evaporator 16 to the air-intake end of the compressor 9. It allows the refrigerant medium to simultaneously flow through the first evaporator 15 and the second evaporator 16. So that the heat pump system can use the first evaporator 15 to absorb heat from the exhaust air and use the second evaporator 16 to absorb heat from the air in the environment, simultaneously.

Embodiment 2

As shown in FIG. 3, in the present embodiment, the air-out end of the first evaporator 15 is respectively communicated with the air-intake end of the second evaporator 16 and the air-intake end of the compressor 9 of the heat pump system through the third three-way control valve 17. The air-out end of the second evaporator 16 is communicated with the air-intake end of the compressor 9 through a one-way valve 18. The flow direction of the refrigerant medium in the one-way valve 18 is from the second evaporator 16 to the compressor 9, so that the first evaporator 15 and the second evaporator 16 are arranged in series and then are connected to the heat pump system.

The corresponding control valves are respectively arranged at the air-intake end and the air-out end of the first evaporator 15 and the second evaporator 16 arranged in series so as to control the flow direction of the refrigerant medium. So that realizes the purposes that the first evaporator 15 and the second evaporator 16 simultaneously absorb heat by using the refrigerant medium flowing through them, or the first evaporator 26 individually absorb heat by using the refrigerant medium flowing through it.

Preferably, in this embodiment, when the dryer is at different working stages, the heat pump is correspondingly in different states to improve the heat absorption saturation of the refrigerant medium and improve the working efficiency of the heat pump system. Specific implementations are as follows:

At the later stage of the drying process of the dryer, the heat pump system is in the first state. The third three-way control valve 17 is only communicated with the air-out end of the first evaporator 15 and the air-intake end of the compressor. It allows the refrigerant medium to only flow through the first evaporator 15, without flowing through the second evaporator 16. So that the heat pump system only uses the first evaporator 15 to absorb heat from the exhaust air.

At the earlier stage of the drying process of the dryer, the heat pump system is in the second state. The third three-way control valve 17 communicates the air-out end of the first evaporator 15 to the air-intake end of the second evaporator 16. It enables the refrigerant medium to flow through the first evaporator 15 and the second evaporator 16 in turn. So that the heat pump system can simultaneously use the first evaporator 15 to absorb heat from the exhaust air and use the second evaporator 16 to absorb heat from the air in the environment.

Embodiment 3

As shown in FIG. 1, the differences between the present embodiment and the above first and second embodiments are as follows: the heat pump system of the dryer only comprises one evaporator 5. The evaporator 5 crosses the air-exhaust drying air duct 3, so that a first portion 13 of the evaporator is located in the air-exhaust drying air duct 3, and the second portion 14 of the evaporator is located in the outside. It enables that the refrigerant medium flowing through the evaporator can flow through the first portion 13 and the second portion 14 in turn. So that the evaporator absorbs heat from the exhaust air using the first portion 13 and absorb heat from the air in the environment using the second portion 14 to realize the purpose of improving the heat absorbing efficiency of the heat pump system.

The implementation solutions of the foregoing embodiments can be further combined or replaced. The embodiments are merely the description of the preferred embodiments of the present invention, but are not intended to limiting the conception and scope of the present invention. Without departing from the scope of the technical solution of the present invention, any changes and modifications made according to the technical essence of the present invention by any persons skilled in the present invention shall all be covered within the scope of the technical solution of the present invention.

The invention claimed is:

1. A high efficiency vented dryer, comprising: an outer drum, an air-intake drying air duct and an air-exhaust drying air duct for allowing the outer drum to communicate with the outside respectively, wherein:

the dryer is further provided with a heat pump system, the heat pump system comprises a first evaporator and a second evaporator arranged in parallel or in series, the first evaporator is arranged in the air-exhaust drying air duct and the second evaporator is arranged in an external atmosphere so as to absorb heat from the exhaust air and the external air respectively.

2. The high efficiency vented dryer according to claim 1, wherein an air-intake end and an air-out end of the first evaporator and the second evaporator are respectively provided with a control valve for controlling on-off, so that the refrigerant medium in the heat pump system flows through the first evaporator and the second evaporator independently or at the same time.

3. The high efficiency vented dryer according to claim 2, wherein the air-intake end of the first evaporator and the air-intake end of the second evaporator are respectively communicated with an air-out end of a throttling device of the heat pump system through a first three-way control valve; and the air-out end of the first evaporator and the air-out end of the second evaporator are respectively communicated with an air-out end of a compressor of the heat pump system through a second three-way control valve.

4. The high efficiency vented dryer according to claim 2, wherein the air-out end of the first evaporator is respectively communicated with the air-intake end of the second evaporator and an air-intake end of a compressor of the heat pump system through a third three-way control valve;

the air-out end of the second evaporator communicates with the air-intake end of the compressor of the heat pump system through a one-way valve.

5. The high efficiency vented dryer according to claim 3, wherein at a later stage of a drying process of the dryer, the heat pump system is in a first state in which the refrigerant medium only flows through the first evaporator without flowing through the second evaporator;

at an earlier stage of the drying process of the dryer, the heat pump system is in a second state in which the refrigerant medium simultaneously flows through the first evaporator and the second evaporator.

6. The high efficiency vented dryer according to claim 1, wherein a condenser of the heat pump system is arranged in the air-intake drying air duct, an air-intake end of the condenser communicates with an air-out end of a compressor of the heat pump system, and an air-out end of the condenser communicates with an air-intake end of a throttling device of the heat pump system.

7. The high efficiency vented dryer according to claim 6, wherein the compressor of the heat pump system is arranged in the air-intake drying air duct located upstream from the condenser to preheat the intake air stream.

8. The high efficiency vented dryer according to claim 6, wherein the air-intake drying air duct is provided with an auxiliary heating wire, the auxiliary heating wire is located downstream from the condenser, and the air-exhaust drying air duct is provided with a first fan controlling the flow direction of the air stream, the first fan is located upstream from the first evaporator.

9. The high efficiency vented dryer according to claim 8, wherein a second fan is arranged outside the air-exhaust drying air duct and is close to an air inlet of the second evaporator.

10. The high efficiency vented dryer according to claim 4, wherein at a later stage of a drying process of the dryer, the heat pump system is in a first state in which the refrigerant medium only flows through the first evaporator without flowing through the second evaporator;

at an earlier stage of the drying process of the dryer, the heat pump system is in a second state in which the refrigerant medium simultaneously flows through the first evaporator and the second evaporator.

11. The high efficiency vented dryer according to claim 2, wherein a condenser of the heat pump system is arranged in the air-intake drying air duct, an air-intake end of the condenser communicates with an air-out end of a compressor of the heat pump system, and an air-out end of the condenser communicates with an air-intake end of a throttling device of the heat pump system.

12. The high efficiency vented dryer according to claim 3, wherein a condenser of the heat pump system is arranged in the air-intake drying air duct, an air-intake end of the condenser communicates with an air-out end of the compressor of the heat pump system, and an air-out end of the condenser communicates with an air-intake end of the throttling device of the heat pump system.

13. The high efficiency vented dryer according to claim 4, wherein a condenser of the heat pump system is arranged in the air-intake drying air duct, an air-intake end of the condenser is communicated with an air-out end of the compressor of the heat pump system, and an air-out end of the condenser is communicated with an air-intake end of a throttling device of the heat pump system.

14. A high efficiency vented dryer, comprising an outer drum, an air-intake drying air duct and an air-exhaust drying air duct for allowing the outer drum to communicate with the outside respectively, wherein:

the dryer is further provided with a heat pump system, an evaporator of the heat pump system crosses the air-exhaust drying air duct, so that a first portion of the evaporator is located in the air-exhaust drying air duct while a second portion of the evaporator is located in the outside.

* * * * *